US005834788A

United States Patent [19]

Fu et al.

[11] Patent Number: 5,834,788

[45] Date of Patent: Nov. 10, 1998

[54] TUNGSTEN CONTAINER FOR RADIOACTIVE IODINE AND THE LIKE

[75] Inventors: Monty Mong Chen Fu, Canyon Country; Bing Bing Zhu, Northridge; Richard L. Green, Simi Valley; Chris K. Fitz, Woodland Hills, all of Calif.

[73] Assignee: Syncor International Corp., Woodland Hills, Calif.

[21] Appl. No.: 866,919

[22] Filed: May 30, 1997

[51] Int. Cl.[6] ..... G21F 5/00

[52] U.S. Cl. ..... 250/506.1

[58] Field of Search ..... 250/506.1, 505.1

[56] References Cited

U.S. PATENT DOCUMENTS

| | | | |
|---|---|---|---|
| D. 208,080 | 7/1967 | Hamilton . | |
| D. 324,101 | 2/1992 | Reif et al. . | |
| D. 333,347 | 2/1993 | Kemp et al. . | |
| 2,682,352 | 6/1954 | Hawkins . | |
| 2,812,231 | 11/1957 | Zar . | |
| 3,074,542 | 1/1963 | Myerson et al. . | |
| 3,101,841 | 8/1963 | Baldwin . | |
| 3,149,717 | 9/1964 | Castelli . | |
| 3,272,322 | 9/1966 | Ogle . | |
| 3,294,231 | 12/1966 | Vanderbeck . | |
| 3,329,146 | 7/1967 | Waldman, Jr. . | |
| 3,344,787 | 10/1967 | MacLean . | |
| 3,367,488 | 2/1968 | Hamilton . | |
| 3,531,644 | 9/1970 | Koster . | |
| 3,673,411 | 6/1972 | Glasser . | |
| 3,677,247 | 7/1972 | Brown . | |
| 3,731,100 | 5/1973 | Lattin . | |
| 3,882,315 | 5/1975 | Soldan . | |
| 3,971,955 | 7/1976 | Heyer et al. . | |
| 4,062,353 | 12/1977 | Foster et al. . | |
| 4,081,688 | 3/1978 | Fries | 250/506.1 |
| 4,106,622 | 8/1978 | Windischman . | |
| 4,113,090 | 9/1978 | Cartens . | |
| 4,122,836 | 10/1978 | Burnett . | |
| 4,307,713 | 12/1981 | Galkin et al. . | |
| 4,357,541 | 11/1982 | Ernst . | |
| 4,382,512 | 5/1983 | Furminger . | |
| 4,393,864 | 7/1983 | Galkin et al. . | |
| 4,401,108 | 8/1983 | Galkin et al. . | |
| 4,673,813 | 6/1987 | Sanchez . | |
| 4,745,907 | 5/1988 | Russel, Jr. et al. . | |
| 4,781,697 | 11/1988 | Slaughter . | |
| 4,846,235 | 7/1989 | Handke . | |

(List continued on next page.)

OTHER PUBLICATIONS

Advertisement: May 1996, "The Solution To A Burden Syringe Is As Easy As 1–2–3," by Capintec, Inc.
Advertisement for "Syringe Shields"no date.
Advertisement for "Pro–Tec III® Syringe Shield", no date.
Advertisement for "Pro–Tec II® Syringe Shield" no date.
Advertisement for "Pro–Tec B Syringe Shield" no date.
Advertisement for "Pro–Tec® Syringe Shield" do date.
Syncor Corporation Brochure "Introducing The SECURE™ Safety Injection Shield Another Safety First".

*Primary Examiner*—Kiet T. Nguyen
*Attorney, Agent, or Firm*—Sheppard, Mullin, Richter & Hampton LLP; Gary A. Clark, Esquire

[57] ABSTRACT

An improved radiation dense container for transporting radioactive iodine and the like, including a cup-shaped base having a cavity with an opening that is sized to receive radioactive iodine in the form of either one or more iodine capsules or a vial of iodine solution. The vial has a cap with a septum through which the radioactive iodine solution can be withdrawn from the vial in situ by an oral radioisotope administration set. A lid threadedly engages the base over the cavity opening to substantially seal it when threaded in place and to allow the insertion and removal of the radioactive iodine when removed. The base and the lid are both formed of tungsten. The container includes one or more activated charcoal filters to absorb any gases given off by the radioactive iodine when sealed in the cavity. An inner cup-shaped container and cap, made of plastic and sized and configured for a close fit within the base cavity, may be utilized to conveniently hold the capsules or, optionally, the vial.

15 Claims, 4 Drawing Sheets

U.S. PATENT DOCUMENTS

| | | |
|---|---|---|
| 4,851,702 | 7/1989 | Perlman . |
| 4,869,299 | 9/1989 | Handke . |
| 4,892,525 | 1/1990 | Hermann, Jr. et al. . |
| 4,917,263 | 4/1990 | Korb . |
| 5,042,679 | 8/1991 | Crowson et al. . |
| 5,066,597 | 11/1991 | Stinson et al. . |
| 5,096,062 | 3/1992 | Burkhardt et al. . |
| 5,099,998 | 3/1992 | Curzon et al. . |
| 5,145,063 | 9/1992 | Lee . |
| 5,157,900 | 10/1992 | Kupersmit . |
| 5,205,408 | 4/1993 | Cobb . |
| 5,245,117 | 9/1993 | Withers et al. . |
| 5,274,239 | 12/1993 | Lane et al. . |
| 5,277,312 | 1/1994 | Vumbaca . |
| 5,303,836 | 4/1994 | Childress . |
| 5,323,719 | 6/1994 | Withers et al. . |
| 5,385,105 | 1/1995 | Withers, Jr. et al. . |
| 5,397,902 | 3/1995 | Castner et al. . |
| 5,417,326 | 5/1995 | Winer . |
| 5,519,931 | 5/1996 | Reich . |
| 5,536,945 | 7/1996 | Reich . |
| 5,552,612 | 9/1996 | Katayama et al. . |
| 5,672,883 | 9/1997 | Reich . |

TUNGSTEN CONTAINER FOR RADIOACTIVE IODINE AND THE LIKE

BACKGROUND OF THE INVENTION

The present invention generally relates to shielded containers for the handling of radioactive materials and, more particularly, to radiation dense shields allowing improved handling of radioactive iodine and the like used in the health care industry.

In the health care industry, and more specificially, in the field of nuclear medicine, radioactive materials known as radiopharmaceuticals are used in various applications, including non-invasive imaging of patients for various diagnostic, as well as therapeutic, purposes. Over the years, the health care industry has developed many different radiopharmaceuticals designed to facilitate such applications. One such radiopharmaceutical is radioactive iodine, which is administered orally via capsules or in a liquid form to a patient.

Because of the radioactive nature of radiopharmaceuticals, they should be handled carefully and various governmental agencies, including the U.S. Department of Transportation, the Nuclear Regulatory Commission, and the Occupational Health and Safety Administration, have promulgated regulations for safe handling of such materials. To avoid some of the overhead costs associated with addressing the above concerns, many hospitals have resorted to outside pharmacy companies having expertise in the compounding and handling of radiopharmaceuticals.

Typically, health care providers order radiopharmaceuticals in individual doses for specific patients. Conventionally, such radiopharmaceuticals are transported and handled within a hospital in containers known as radiopharmaceutical pigs that utilize lead shielding. While such radiopharmaceutical pigs have been generally satisfactorily, they have certain drawbacks. For example, they are bulky and heavy due to their use of lead for shielding against radioactivity. Another drawback is that radioactive iodine can release gases which can accumulate in the enclosed radiopharmaceutical pigs and pose a hazard to personnel when the radiopharmaceutical pigs are opened for removal of the radioactive iodine.

Accordingly, there exists a need for a more compact and lighter weight container for transporting and handling radioactive iodine and the like that reduces the hazard presented by buildup of gases released by the radioactive iodine. The present invention satisfies this need and provides further related advantages.

SUMMARY OF THE INVENTION

Briefly, and in general terms, the present invention resides in an improved radiation dense container for transporting radioactive iodine and the like. This container has a number of significant advantages, including that it is relatively lightweight and compact as compared to prior containers, reduces the potential hazard associated with buildup of gases in the container from the radioactive iodine, and simplifies the handling of patient iodine solution administration for greater convenience and safety.

More specifically, and by way of example only, a container in accordance with the present invention comprises a base having an outer surface, the base including a wall defining a cavity in the base having interior bottom and side surfaces, and the wall further defining an opening into the cavity through the outer surface of the base. In the preferred embodiment, the base is generally cup-shaped. The cavity formed in the base is sized to receive the radioactive iodine, in the form of either one or more iodine capsules or a shatter-resistant vial of iodine solution. The vial may include a cap with a septum through which the radioactive iodine solution can be drawn from the vial in situ by an oral radioisotope administration set. As a result, the invention allows patient iodine solution administration from a closed system.

A lid is configured to releasably engage the base over the opening in its outer surface. In the preferred embodiment, the lid is configured to threadedly engage, the base. The lid, when engaged with the base, substantially seals the cavity and, when disengaged from the base, allows the insertion and removal of the radioactive iodine. Advantageously, the base and the lid are both formed of tungsten, resulting in a container that is relatively lightweight and compact in construction.

In a further aspect of the present invention, one or more filters comprising activated charcoal are provided in the container, in communication with the cavity, to absorb any gases given off by the radioactive iodine when sealed in the cavity. For example, in the preferred embodiment herein, the container includes a first activated charcoal filter mounted adjacent to the opening in the cavity and a second activated charcoal filter mounted adjacent the interior bottom surface of the cavity. In the preferred embodiment the first activated charcoal filter is in the form of a filter ring, and a counterbore is formed in the cavity opening, to create an annular seat at the juncture of the counterbore and the cavity on which the activated charcoal filter ring is mounted. The second activated charcoal filter, in the preferred embodiment, is in the form of a filter disk disposed on the interior bottom surface of the cavity. In addition, an absorbent sponge may be mounted on a bottom surface of the lid, facing the cavity formed in the base, to cushion the contents of the container against damage during transport and handling.

The radiation dense container of the present invention may also include an inner container, which preferably is also cup-shaped and is sized and configured for a close fit within the cavity. The inner container has an inner cavity with an opening that is aligned with the opening in the cavity formed in the base of the container to receive the radioactive iodine. The inner container may be provided with a cap that is configured to releasably engage the inner container over its opening. The cap may be configured to releasably engage the inner container with an interference fit, such as a snap or friction fit. The cap, when engaged with the inner container, closes the inner cavity and, when disengaged with the inner container, allows the insertion and removal of the radioactive iodine relative to the inner cavity. The inner container can be used as a conveniently removable container for adminstering the capsules to a patient, or to house the solution vial. In the latter case, neither the container nor the vial need to be removed to administer the dose, and by reclosing the inner container with its cap after dosing, the inner container can provide contamination free disposal of the vial. Preferably, both the inner container and the lid are formed of a non-metallic material, such as a shatter-resistant plastic.

Other features and advantages of the present invention will become apparent from the following description of the preferred embodiment, taken in conjunction with the accompanying drawings, which illustrate, by way of example, the principles of the invention.

BRIEF DESCRIPTION OF THE DRAWINGS

The following drawings illustrate a presently preferred embodiment of the invention, in which.

DESCRIPTION OF THE PREFERRED EMBODIMENT

Figure 1:
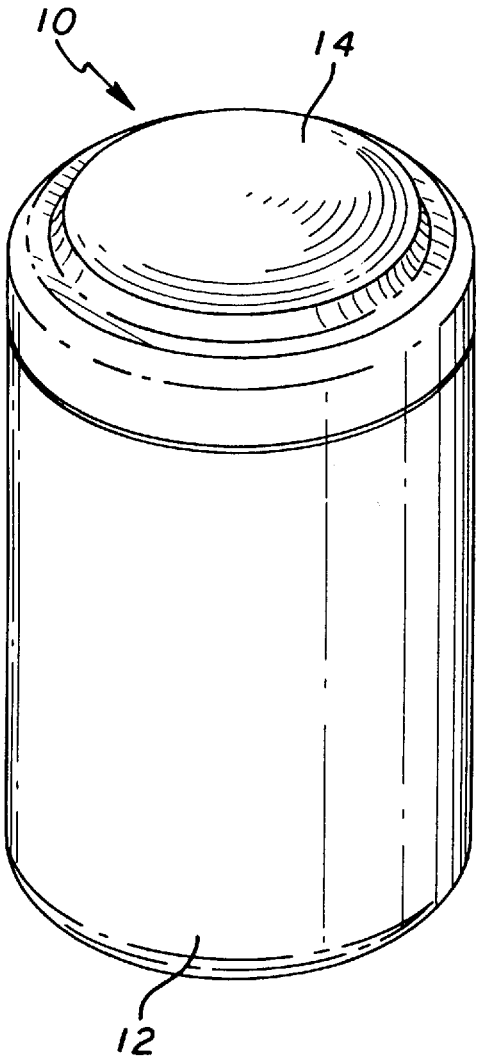
FIG. 1 is a perspective view of a tungsten container for radioactive iodine in accordance with the invention.
Figure 2:
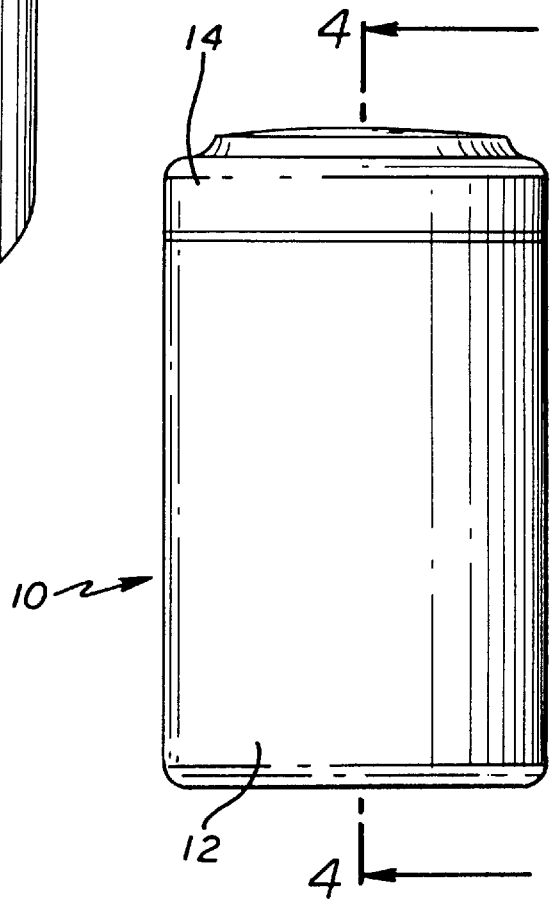
FIG. 2 is a side view of the tungsten container of FIG. 1.

Referring now to the drawings, and particularly to FIGS. 1–2 thereof, there is shown by way of example only a radiation-shielded container, indicated generally by reference numeral 10, in accordance with the present invention. The container includes a cylindrical, cup-shaped base 12 and a generally circular lid 14 of equal diameter. Both the base and the lid are formed of tungsten, rather than lead, so that the container can be made lighter and more compact in construction, while still providing adequate shielding from the radiation emitted by the radioactive iodine contained within the container. Furthermore, due to its material properties, the tungsten itself can be threaded, thereby providing for a directly threaded junction between the lid and the base. Such a junction was not available with conventional lead shields.

Figure 3:
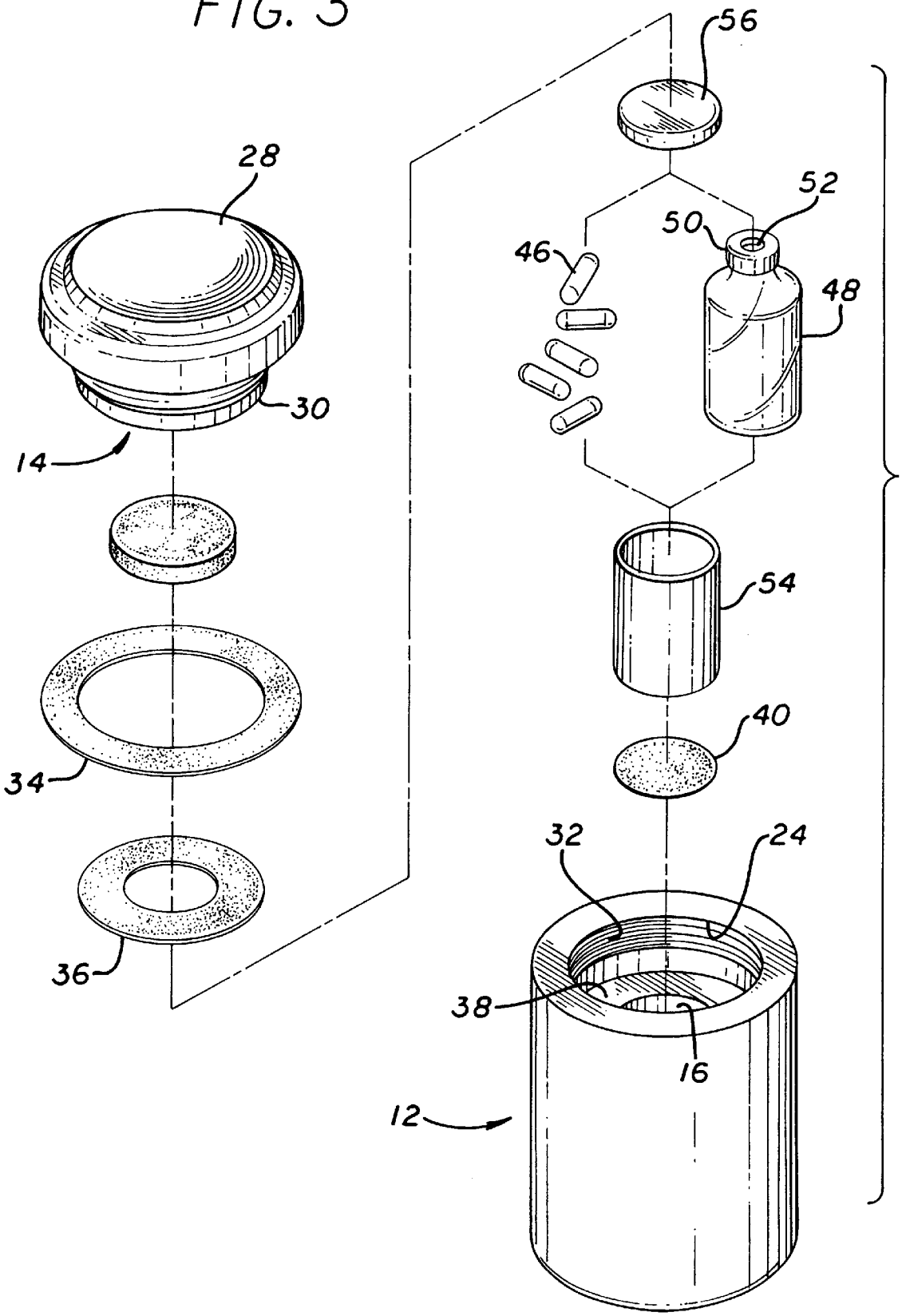
FIG. 3 is an exploded, perspective view of the tungsten container of FIG. 1 showing its individual components, including an inner container having as contents, alternatively, a number of iodine capsules or a vial of iodine solution.
Figure 4A:
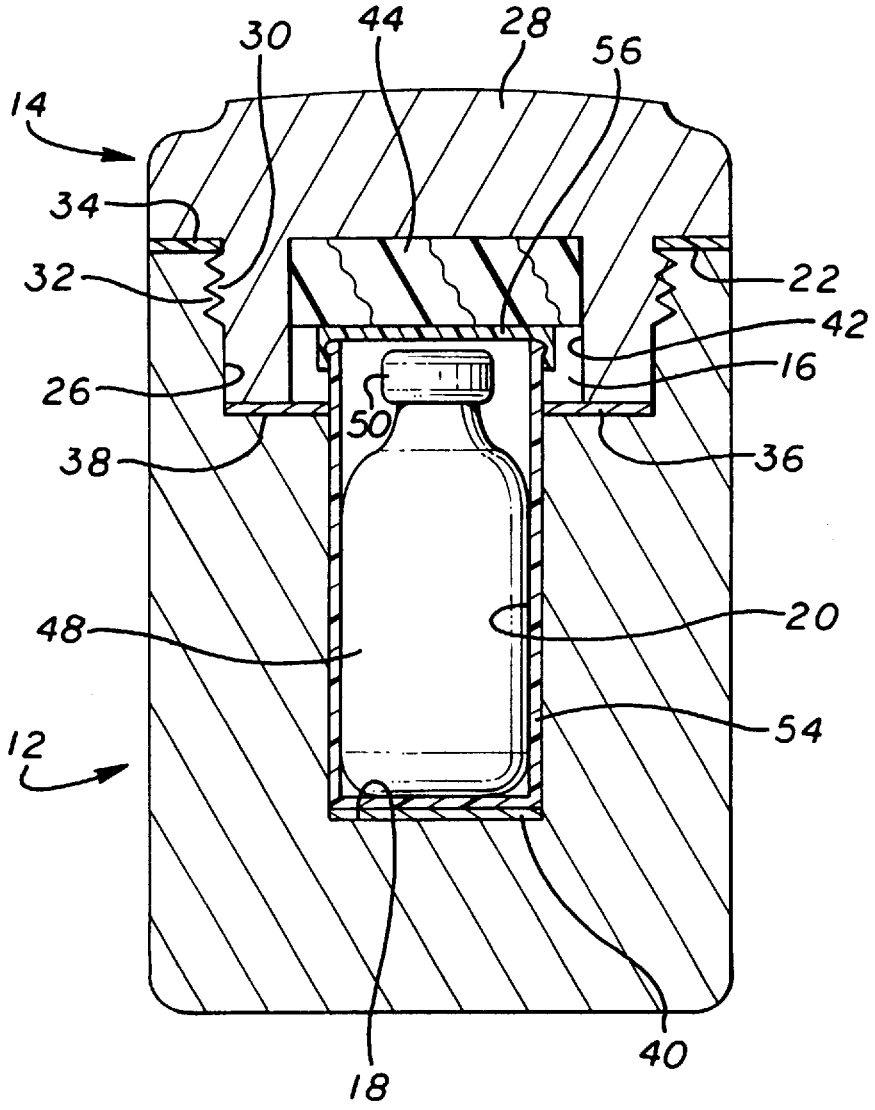
FIG. 4A is a cross sectional view, taken along the line 4—4 in FIG. 2, showing the tungsten container with a vial of iodine solution therein.
Figure 4B:
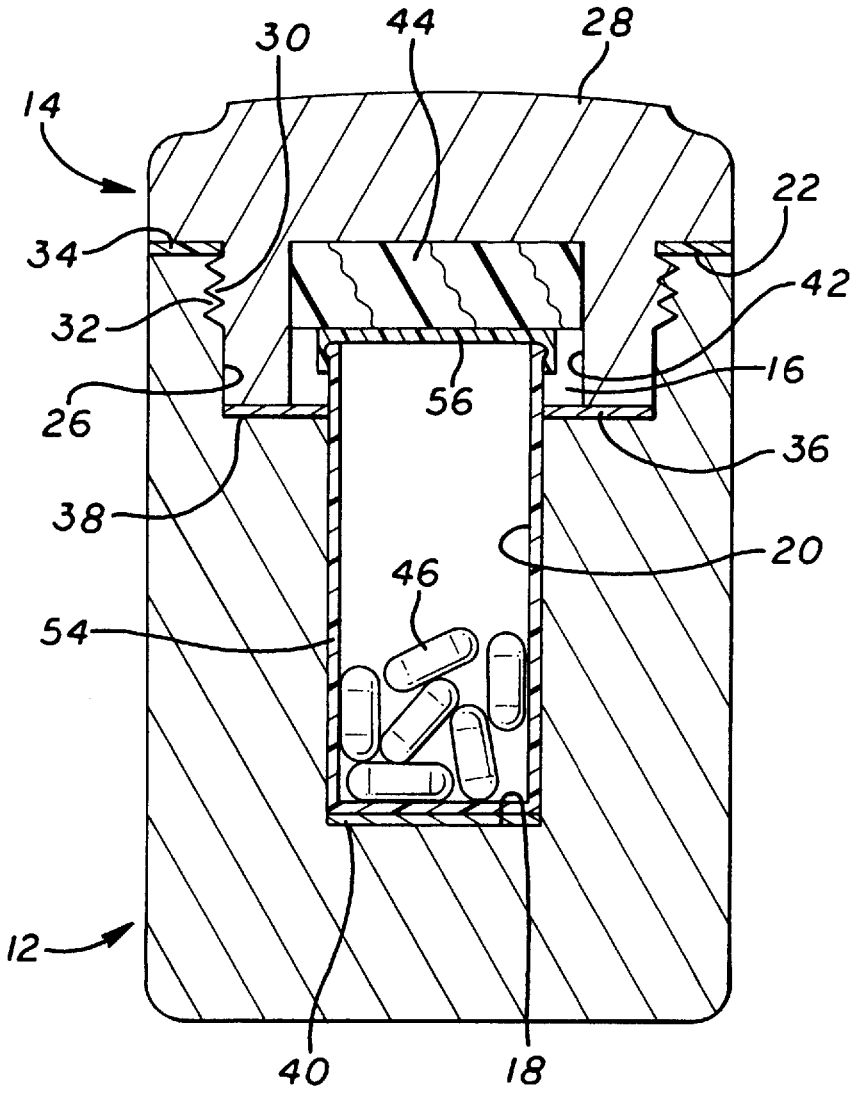
FIG. 4B is an alternative cross sectional view, also taken along the line 4—4 in FIG. 2, showing the tungsten container with iodine capsules therein.

Turning to FIGS. 3 and 4A–4B, the base 12 has a cavity 16 formed therein defined by an interior bottom wall 18 and an interior cylindrical side wall 20. Access to the cavity 16 is provided through an upper surface 22 of the base by a circular opening 24 therein. The opening is enlarged by a counterbore 26 to receive the lid 14. The lid has an enlarged head portion 28 for easier grasping and manipulation, and threads 30 are formed in the lid to threadedly engage complementary threads 32 formed in the counterbore of the base. A gasket 34 in the shape of an annular ring is provided to seal the juncture between the lid and the base at its upper surface and prevent any gas given off by the radioactive iodine from escaping when the lid is in place, since such gas can have harmful effects.

In order to absorb gases that may be given off by the radioactive iodine contained within the container 10, two activated charcoal filters are provided. A first activated charcoal filter 36, in the form of a filter ring, is mounted on an annular seat 38 formed at the bottom of the counterbore 26, adjacent the opening 24 in the cavity 16. A second activated charcoal filter 40, in the form of a disk, is disposed on the surface of the interior bottom wall 18 of the cavity. This second filter also acts to absorb any radioactive iodine that may be accidentally discharged within the container. Additionally, a blind bore 42 is formed in the interior surface of the lid 14 to hold an absorbent sponge 44 to cushion the contents of the container against damage during transport and handling.

The container 10 of the present invention is conveniently adapted to contain radioactive iodine in the form of either capsules 46 or a solution in a vial 48. The vial has a cap 50 with a rubber septum 52 that allows the solution to be withdrawn by an oral radioisotope administration set (not shown), through the septum, without removing the cap of the vial. Thus, the invention advantageously allows iodine solution administration from a closed system without need for removing the vial from the container. The vial and its cap are preferably made of a shatter resistant plastic material in the event the vial is dropped or jarred within container 10 during handling.

To hold the capsules 46 and allow for their easy removal from the base 12, or, alternatively, to contain the vial 48 within the base, a cylindrical, cup-shaped inner container 54 is provided with a cap 56 that fits over the open upper end of the inner container. The inner container is sized and configured to be received within the cavity 16 in the base with a close fit. Both the inner container and its cap are similarly made of a shatter resistant plastic material, and they are configured such that the cap is retained on the inner container by an interference fit, such as the snap fit illustrated in FIG. 4B.

In use, the inner container 54 itself can be readily removed for access to the capsules 46, since the base 12 is relatively heavy despite being constructed of tungsten. Alternatively, if the vial 48 is used, both the inner container and the vial can be left in place, and the solution can be withdrawn by an oral radioisotope administration set through the rubber septum 52 in the vial cap 50. After dosing with the iodine solution is complete, the cap 56 can be used to reclose the inner container, which then can be used for contamination free disposal of the vial.

While a particular form of the invention has been illustrated and described, it will be apparent that various modifications can be made without departing from the spirit and scope of the invention. Accordingly, it is not intended that the invention be limited except as set forth in the following claims.

We claim:

1. A radiation dense container for transporting radioactive iodine or other radiopharmaceuticals, comprising:

a base having an outer surface, the base including a wall defining a cavity in the base having interior bottom and side surfaces, the wall further defining an opening into the cavity through the outer surface of the base, the cavity sized to receive the radioactive iodine therein;

a lid configured to releasably engage the base over the opening in the outer surface thereof, the lid when engaged with the base substantially sealing the cavity, and the lid when disengaged from the base allowing the insertion and removal of the radioactive iodine relative to the cavity, the base and the lid both formed of tungsten; and a first activated charcoal filter mounted in the base, in communication with the cavity, to absorb any gas given off by the radioactive iodine when sealed in the cavity.

2. The radiation dense container as set forth in claim 1, and further including a second activated charcoal filter mounted in the base, in communication with the cavity.

3. The radiation dense container as set forth in claim 2, wherein the first activated charcoal filter is mounted adjacent the opening in the cavity and the second activated charcoal filter is mounted adjacent the interior bottom surface of the cavity.

4. The radiation dense container as set forth in claim 1, and further including an inner container disposed in the cavity, the inner container sized and configured for a close fit within the cavity, the inner container defining an inner cavity therein and an opening into the inner cavity that is aligned with the opening in the cavity to receive the radioactive iodine, the inner container formed of a non-metallic material.

5. The radiation dense container as set forth in claim 4, and further including a cap configured to releasably engage the inner container over the opening therein, the cap when engaged with the inner container closing the inner cavity, and the cap when disengaged with the inner container allowing the insertion and removal of the radioactive iodine relative to the inner cavity, the lid formed of a non-metallic material.

6. The radiation dense container as set forth in claim 4, and further including a plurality of radioactive iodine capsules disposed within the inner cavity of the inner container.

7. The radiation dense container as set forth in claim 1, and further including a vial of radioactive iodine solution disposed within the cavity of the base, the vial including a cap with a septum through which the radioactive iodine solution can be withdrawn from the vial in situ by an oral radioisotope administration set when the lid is disengaged from the base.

8. A radiation dense container for transporting radioactive iodine or other radiopharmaceuticals, comprising:

a cup-shaped base having an outer surface, the base including a wall defining a cavity in the base having interior bottom and side surfaces, the wall further defining an opening into the cavity through the outer surface of the base, the cavity sized to receive the radioactive iodine therein;

a lid configured to threadedly engage the base over the opening in the outer surface thereof, the lid when threaded onto the base substantially sealing the cavity, and the lid when unthreaded from the base allowing the insertion and removal of the radioactive iodine relative to the cavity, the base and the lid both formed of tungsten; and an activated charcoal filter ring mounted adjacent the opening in the base, in communication with the cavity, to absorb any gas given off by the radioactive iodine when sealed in the cavity.

9. The radiation dense container as set forth in claim 8, and further including a counterbore formed in the opening into the cavity, adjacent the outer surface of the base, the juncture of the counterbore and the cavity defining an annular seat on which the activated charcoal filter ring is mounted.

10. The radiation dense container as set forth in claim 9, and further including an activated charcoal filter disk disposed on the interior bottom surface of the cavity.

11. The radiation dense container as set forth in claim 8, and further including an absorbent sponge mounted on a bottom surface of the lid, facing the cavity in the base.

12. The radiation dense container as set forth in claim 8, and further including a cup-shaped inner container disposed in the cavity, the inner container sized and configured for a close fit within the cavity, the inner container defining an inner cavity therein and an opening into the inner cavity that is aligned with the opening in the cavity to receive the radioactive iodine, the inner container formed of a plastic material.

13. The radiation dense container as set forth in claim 12, and further including a cap configured to releasably engage the inner container over the opening therein with an interference fit, the cap when engaged with the inner container closing the inner cavity, and the cap when disengaged with the inner container allowing the insertion and removal of the radioactive iodine relative to the inner cavity, the lid formed of a plastic material.

14. The radiation dense container as set forth in claim 13, and further including a plurality of radioactive iodine capsules disposed within the inner cavity of the inner container.

15. The radiation dense container as set forth in claim 13, and further including a vial of radioactive iodine solution disposed within the cavity of the base, the vial including a cap with a septum through which the radioactive iodine solution can be withdrawn from the vial in situ by an oral radioisotope administration set when the lid is disengaged from the base and the cap is removed from the inner container.

* * * * *